US008978678B1

(12) United States Patent
Ryan

(10) Patent No.: US 8,978,678 B1
(45) Date of Patent: Mar. 17, 2015

(54) MOBILE SHELTERED WORKSTATION

(71) Applicant: Saul Anthony Ryan, Spring Hill, TN (US)

(72) Inventor: Saul Anthony Ryan, Spring Hill, TN (US)

( * ) Notice: Subject to any disclaimer, the term of this patent is extended or adjusted under 35 U.S.C. 154(b) by 0 days.

(21) Appl. No.: 14/016,875

(22) Filed: Sep. 3, 2013

(51) Int. Cl.

| | |
|---|---|
| ***E04H 15/06*** | (2006.01) |
| ***E04H 15/48*** | (2006.01) |
| ***E04H 15/10*** | (2006.01) |
| ***E04H 15/02*** | (2006.01) |
| ***E04H 15/46*** | (2006.01) |

(52) U.S. Cl.
CPC ..... *E04H 15/06* (2013.01); *E04H 15/10* (2013.01); *E04H 15/02* (2013.01); *E04H 15/46* (2013.01)
USPC ..... 135/88.01; 135/150

(58) Field of Classification Search
USPC ..... 135/88.01, 88.02, 88.1, 88.11, 88.12, 135/900, 904, 912, 150
See application file for complete search history.

(56) References Cited

U.S. PATENT DOCUMENTS

| | | | | | |
|---|---|---|---|---|---|
| 739,446 | A * | 9/1903 | Reger | 135/88.02 |
| 1,581,180 | A * | 4/1926 | Csajaghy et al. | 135/150 |
| 1,774,017 | A * | 8/1930 | King | 135/150 |
| 2,960,992 | A * | 11/1960 | Klipfel | 135/136 |
| 2,969,074 | A * | 1/1961 | Willis | 135/142 |
| 2,970,600 | A * | 2/1961 | Schultz | 135/140 |
| 4,250,906 | A * | 2/1981 | Rivier et al. | 296/168 |
| 4,528,998 | A * | 7/1985 | Gamm | 135/75 |
| 4,928,581 | A * | 5/1990 | Jacobson | 454/340 |
| 5,088,511 | A * | 2/1992 | Bain | 134/200 |
| 5,205,089 | A * | 4/1993 | Cunningham | 52/79.1 |
| 5,560,383 | A * | 10/1996 | Fuller | 135/88.01 |
| 5,579,797 | A * | 12/1996 | Rogers | 135/90 |
| 7,188,636 | B1 * | 3/2007 | Kanne et al. | 135/142 |
| 7,896,014 | B1 * | 3/2011 | Chiang | 135/88.04 |
| 7,913,709 | B2 * | 3/2011 | Brebner | 135/33.5 |
| 8,075,653 | B2 * | 12/2011 | Phillips | 55/385.2 |

* cited by examiner

*Primary Examiner* — Noah Chandler Hawk
(74) *Attorney, Agent, or Firm* — Dale J. Ream

(57) ABSTRACT

A mobile sheltered workstation includes a housing. The workstation includes a main support member having a lower end coupled to the housing and extending upwardly therefrom, the main support member being length adjustable and telescopically movable between a retracted configuration and an extended configuration. A canopy framework includes a lower end selectively coupled to an upper end of the main support member and movable between a stowed configuration adjacent the housing and a deployed configuration displaced from the housing. A canopy is selectively coupled to the canopy framework and configured to cover a geometric area thereof.

14 Claims, 13 Drawing Sheets

MOBILE SHELTERED WORKSTATION

BACKGROUND OF THE INVENTION

This invention relates to weather shelters and, more particularly, to a mobile sheltered workstation that provides shelter to a worker from weather elements.

Persons working outdoors often need a quick and convenient portable shelter from the weather. Gardeners, painters, utility workers, carpenters, builders, contractors, and coaches may need shelter from the blazing sun while they work. Police officers working an accident scene may need shelter from rain or snow. A mobile sheltered workstation can improve work conditions in virtually any location. In addition, workers may also need safe and convenient access to electricity while they work.

Various devices have been proposed in the art for providing a mobile sheltered workstation. Although assumably effective for their intended purposes, the current devices are too bulky, hard and time consuming to setup, and do not provide sufficient shelter. Additionally, the current devices do not provide safe and convenient access to electricity.

Therefore, it would be desirable to have a mobile sheltered workstation that includes a canopy framework that is quickly and easily movable between a stowed configuration and a deployed configuration. Further, it would be desirable to have a mobile sheltered workstation that utilizes cords, pulleys, and linkage assemblies to assist in quickly and easily moving the mobile sheltered workstation from the stowed configuration to the deployed configuration. Additionally, it would be desirable to have a mobile sheltered workstation that includes an electrical power strip within a housing.

SUMMARY OF THE INVENTION

A mobile sheltered workstation according to the present invention includes a housing. The workstation also includes a main support member having a lower end coupled to the housing and extending upwardly therefrom, the main support member being length adjustable and telescopically movable between a retracted configuration and an extended configuration. A canopy framework includes a lower end selectively coupled to an upper end of the main support member and movable between a stowed configuration adjacent the housing and a deployed configuration displaced from the housing. A canopy is selectively coupled to the canopy framework and configured to cover a geometric area thereof.

Therefore, a general object of this invention is to provide a mobile sheltered workstation that selectively shelters a work area.

Another object of this invention is to provide a mobile sheltered workstation, as aforesaid, having a main support member that is length adjustable between various intermediate positions to provide adjustable heights for deployment of a canopy cover over a work area.

Still another object of this invention is to provide a mobile sheltered workstation, as aforesaid, that utilizes cords, pulleys and linkage assemblies to assist in moving the canopy framework from a stowed configuration to a deployed configuration.

Yet another object of this invention is to provide a mobile sheltered workstation, as aforesaid, in which the housing includes an electrical power strip.

A further object of this invention is to provide a mobile sheltered workstation, as aforesaid, that is easy to setup and easy to use.

A still further object of this invention is to provide a mobile sheltered workstation, as aforesaid, that is inexpensive to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
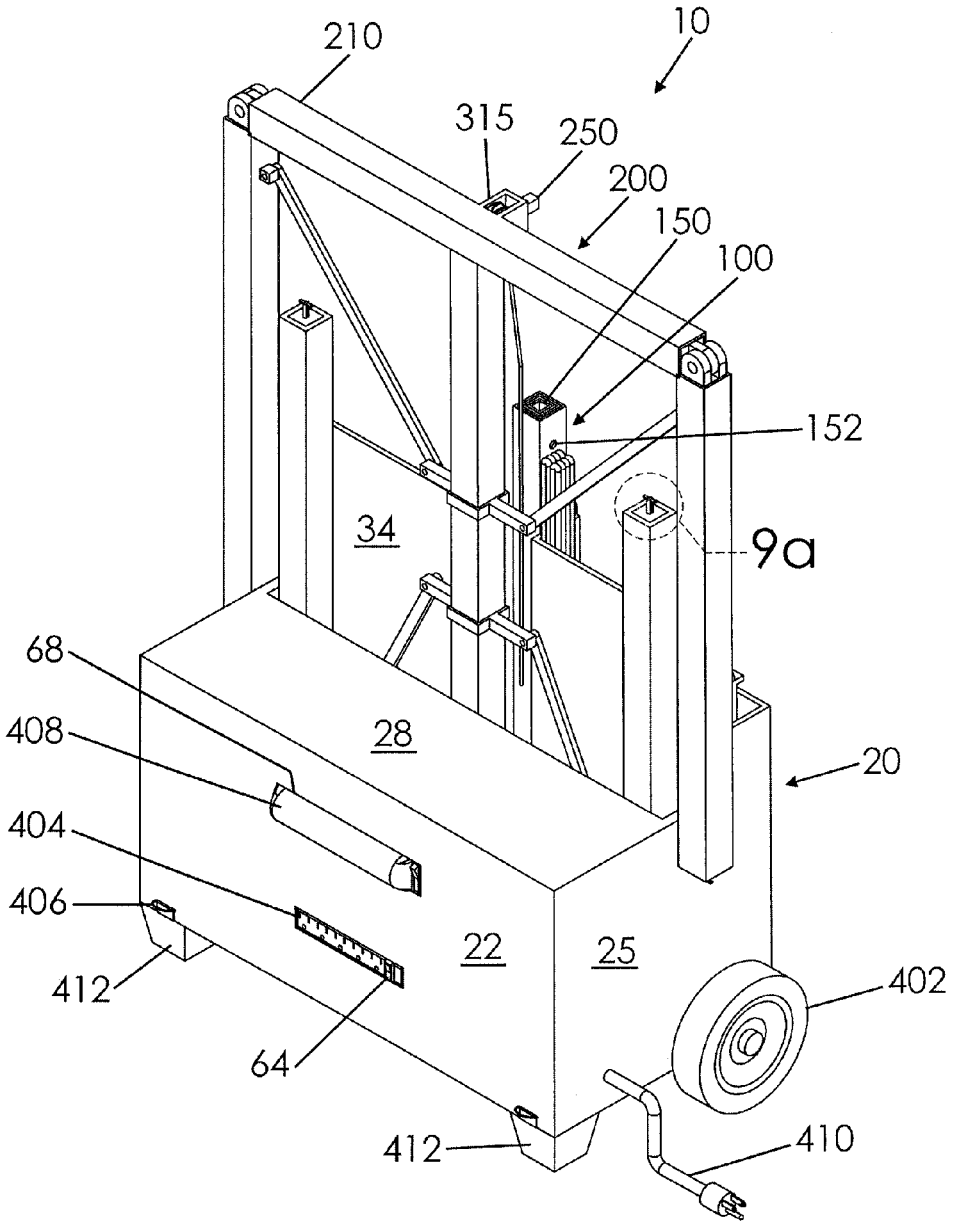
FIG. 1 is a perspective view of a mobile sheltered workstation according to a preferred embodiment of the present invention illustrating a main support member in a retracted configuration, a canopy framework in a stowed configuration, and omitting a canopy from the view.

A mobile sheltered workstation according to a preferred embodiment of the present invention will now be described with reference to FIGS. 1 to 12 of the accompanying drawings. The mobile sheltered workstation 10 includes a housing 20, a main support member 100, and a canopy framework 200. The mobile sheltered workstation 10 may also include a canopy 50 selectively coupled to the canopy framework 200, a plurality of tie down cables 360 selectively coupled to the canopy framework 200 and/or a plurality of tie down stakes 362 selectively coupled to the tie down cables 360.

The housing 20 may include opposed front 22 and rear 24 exterior walls with opposed side exterior walls 25 extending between respective ends of the front 22 and rear 24 exterior walls, respectively. Accordingly, the housing 20 may present a generally square or rectangular configuration although other configurations may also be suitable.

Figure 12:
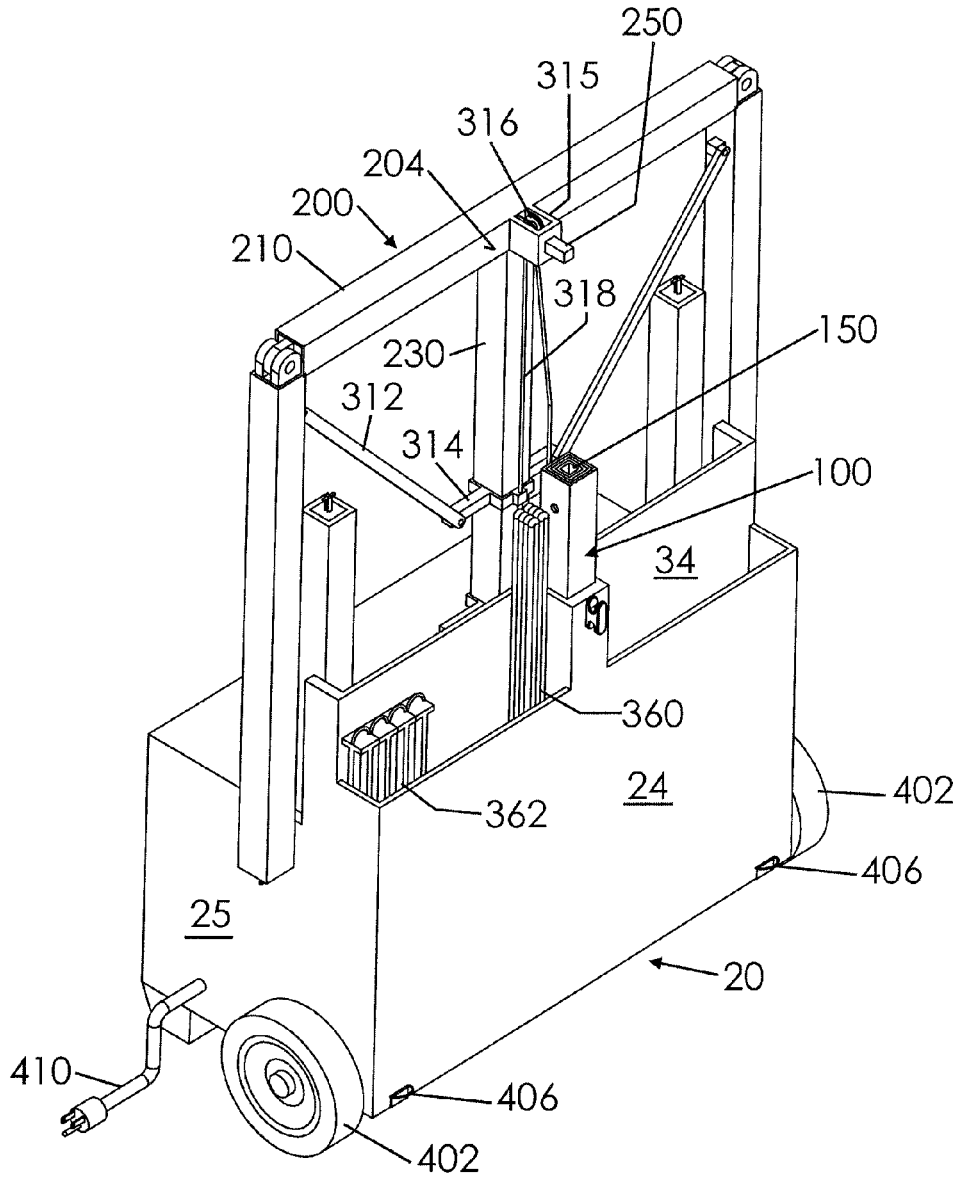
FIG. 12 is a perspective view of the mobile sheltered workstation, as in FIG. 1, shown from a different angle than FIG. 1.
Figure 13A:
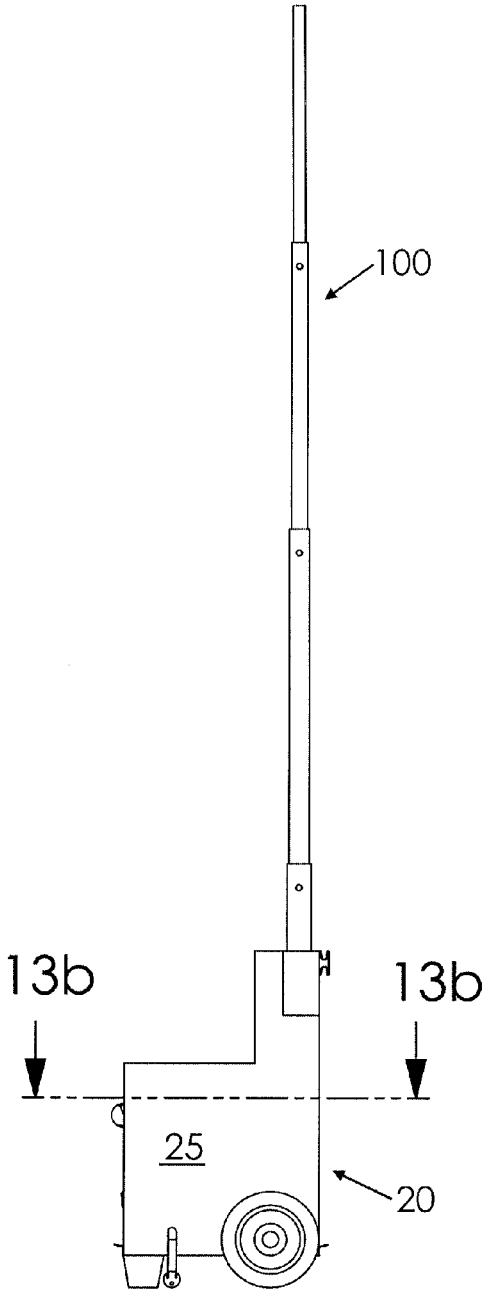
FIG. 13*a* is a side elevation view of the mobile sheltered workstation with the canopy and canopy framework omitted from the view and the main support member in the extended configuration.
Figure 13B:
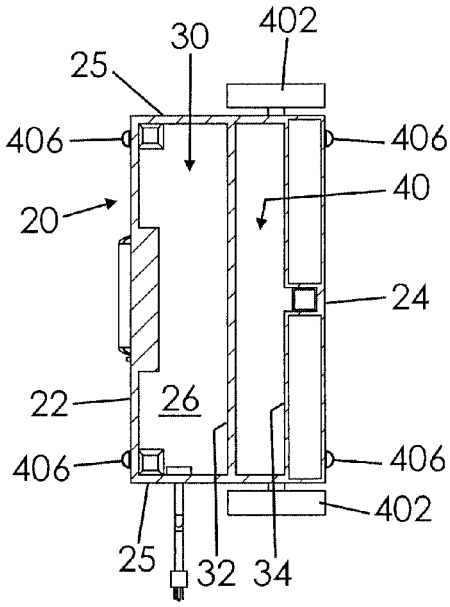
FIG. 13*b* is a sectional view taken along line 13*b*-13*b* of FIG. 13*a*.

The housing 20 may also include a bottom panel 26 extending between respective side exterior walls 25 and respective front 22 and rear 24 exterior walls such that the walls and bottom panel 26 together define an interior area 30. The interior area 30 of the housing 20 may be bisected by opposed front 32 and rear 34 interior walls so as to create a second area 40 located within the interior area 30. The housing 20 may also include a top panel 28 extending between respective side exterior walls 25, the front exterior wall 22, and the front interior wall 32. Accordingly, the configuration of the housing 20 may provide separate compartments suitable for storage of tools, equipment, the canopy framework 200, the canopy 50, the tie down cables 360, and/or the tie down stakes 362. (FIG. 1 and FIG. 12). In one embodiment, the front 32 and/or rear 34 interior walls may be omitted so as to provide different sizes and configurations of storage compartments.

A pair of wheels 402 may be rotatably coupled to opposed side exterior walls 25 of the housing 20 (FIG. 12). It is understood that each wheel 402 may be independently rotatably coupled to a respective side exterior wall 25 or that both wheels 402 may be coupled to one another by an axle that is coupled to the housing 20. A pair of legs 412 may be coupled to the housing 20 and positioned relative to the wheels 402 such that the combination of wheels 402 and the legs 412 creates a stable support structure for the housing 20. A plurality of tie down attachments 406 may be coupled to the housing 20 such that the housing 20 may be staked directly to the ground to provide added stability to the mobile sheltered workstation 10 when at a deployed configuration.

The front exterior wall 22 may define a first aperture 64 and a second aperture 68. An electrical power strip 404 may be situated within the interior area 30 and configured to register with the first aperture 64. Accordingly, the electrical power strip 404 is located at least partially in the interior area 30 of the housing 20 and is operatively accessible from an area outside the housing 20. A light 408 may be configured to register with the second aperture 68 such that the light 408 is located at least partially in the interior area 30 of the housing 20 and is configured to allow the light 408 to illuminate an area outside of the housing 20. Additionally, a power cord 410 may be located at least partially in the interior area 30 of the housing 20 and configured to connect to an exterior power source. It is understood that inclusion and/or positioning of the electrical power strip 404 and/or the light 408 may vary.

Figure 3:
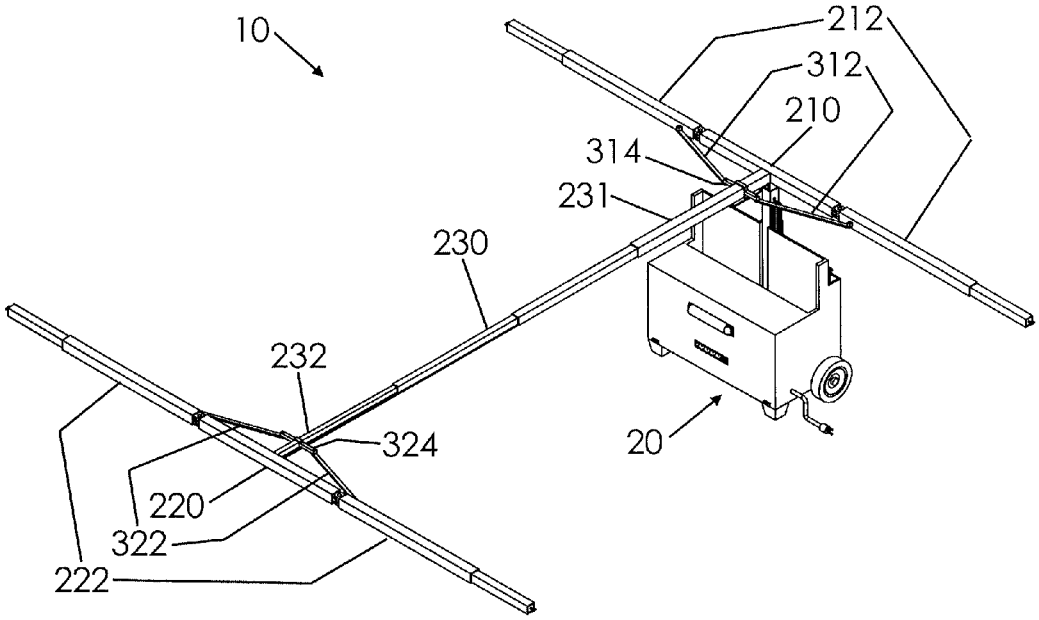
FIG. 3 is a perspective view of the mobile sheltered workstation, as in FIG. 2, illustrating respective pairs of the first and second arms in a deployed and extended configuration and the main support brace in an extended configuration.
Figure 4A:
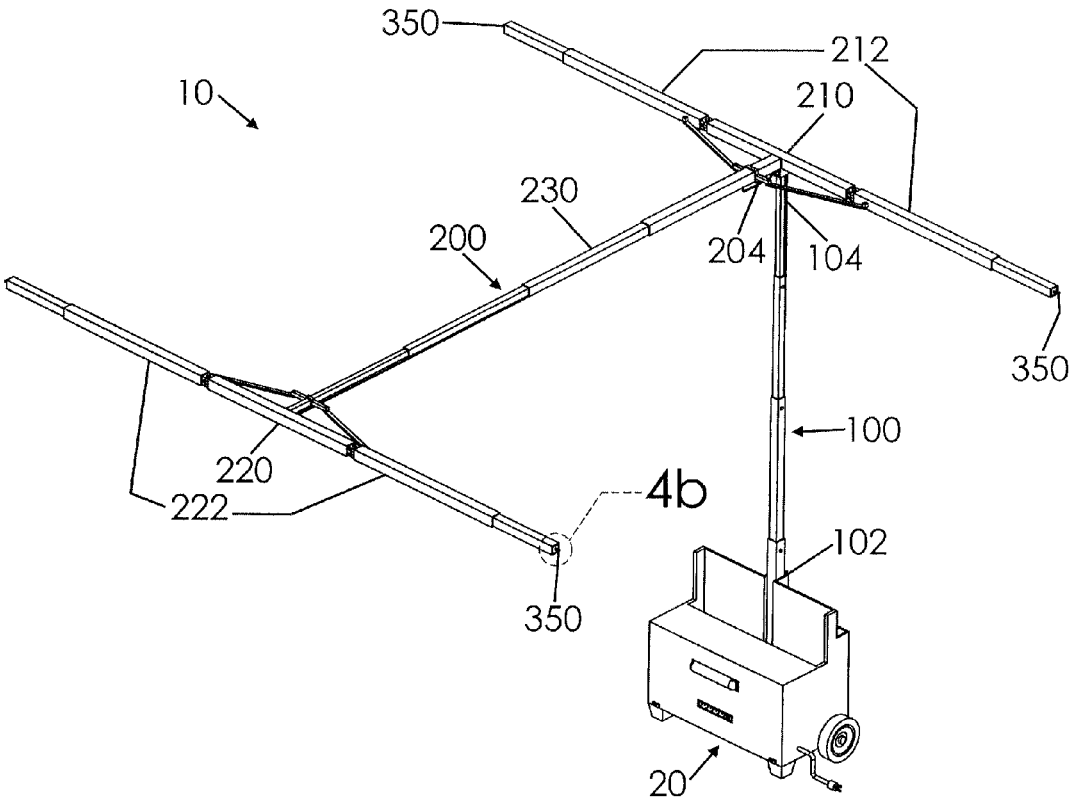
FIG. 4*a* is a perspective view of the mobile sheltered workstation, as in FIG. 3, illustrating the main support member in an extended configuration.
Figure 4B:
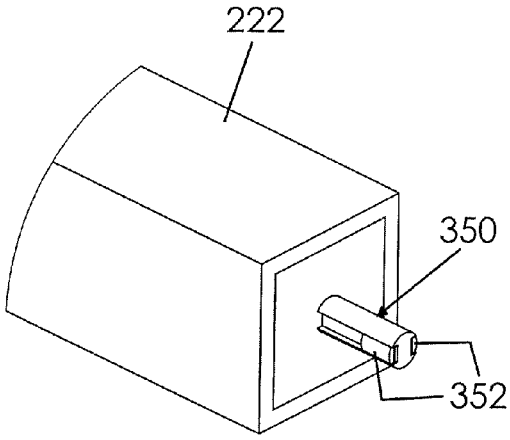
FIG. 4*b* is an isolated view on an enlarged scale taken from FIG. 4*a* showing a pair of springable flanges in a compressed configuration.
Figure 5:
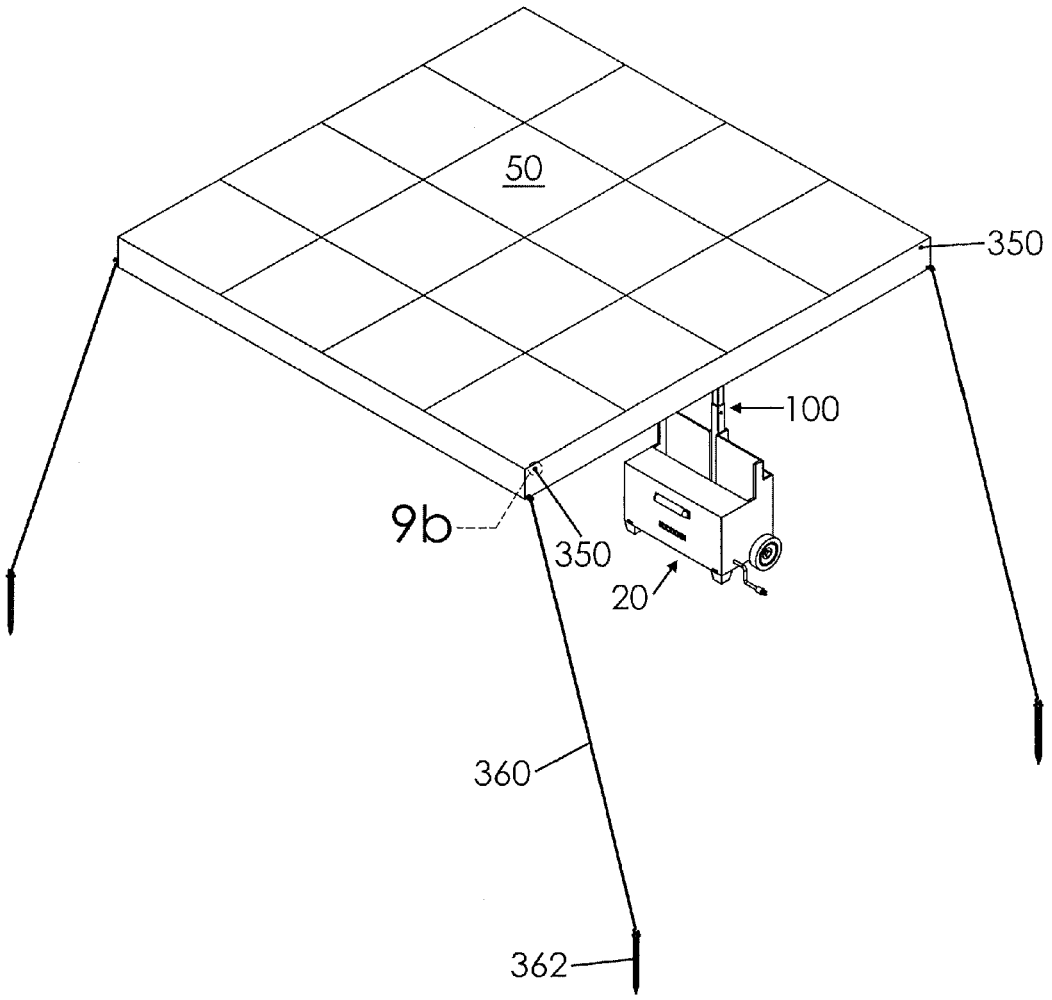
FIG. 5 is a perspective view of the mobile sheltered workstation, as in FIG. 4, illustrating the canopy selectively coupled to the canopy framework, a plurality of tie down cables, each one selectively coupled to the canopy framework, and a plurality of tie down stakes, each one selectively coupled to one of the tie down cables.
Figure 6A:
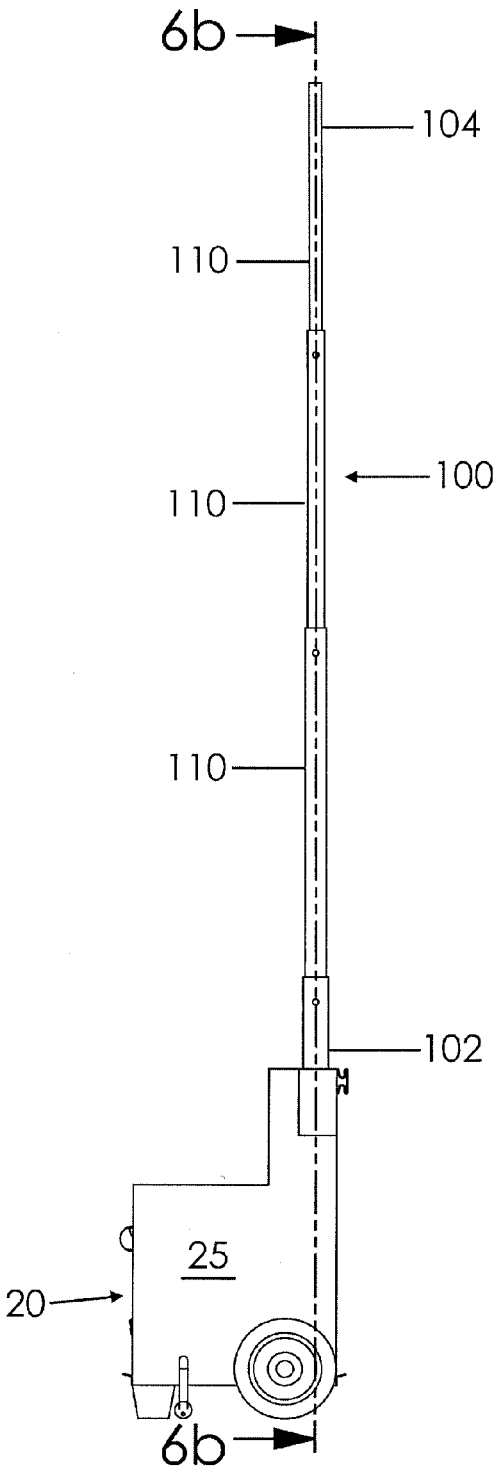
FIG. 6*a* is a side elevation view of the mobile sheltered workstation with the canopy and canopy framework omitted from the view and the main support member in the extended configuration.
Figure 6B:
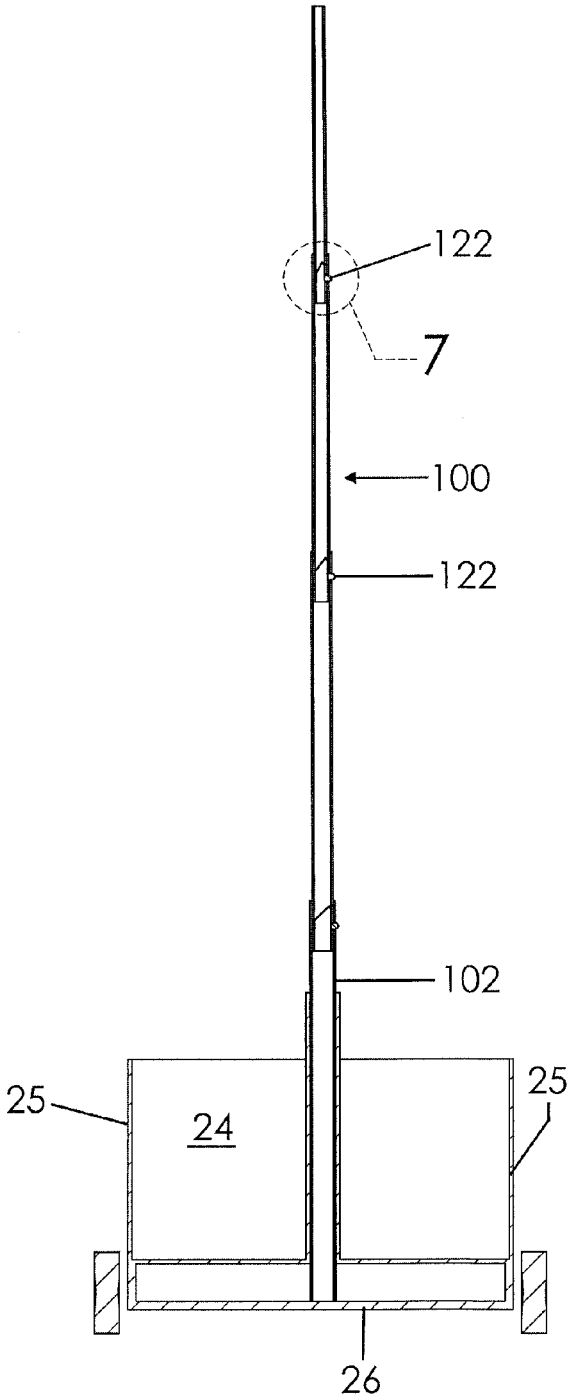
FIG. 6*b* is a sectional view taken along line 6*b*-6*b* of FIG. 6*a;*

The main support member 100 includes a lower end 102 coupled to the housing 20 and extending upwardly therefrom. The main support member 100 may be length adjustable and telescopically movable between a retracted configuration (FIG. 3) and an extended configuration (FIG. 4*a*). More particularly, the main support member 100 may include a plurality of main support member sections 110 configured to nest within the main support member 100 at the retracted configuration and to incrementally extend upwardly from the main support member 100 at the extended configuration.

Each main support member section 110 may be configured so as to be secured at selected positions when the main support member 100 is at the extended configuration. Each main support member section 110 may define at least one hole 120 configured to receive a pin 122 so as to hold the plurality of main support member sections 110 at respective selected positions when respective holes 120 in respective main support member sections 110 receive respective pins 122. It is understood that each main support member section 110 may define a plurality of holes 120 so as to provide a variety of selectable positions.

Figure 7:
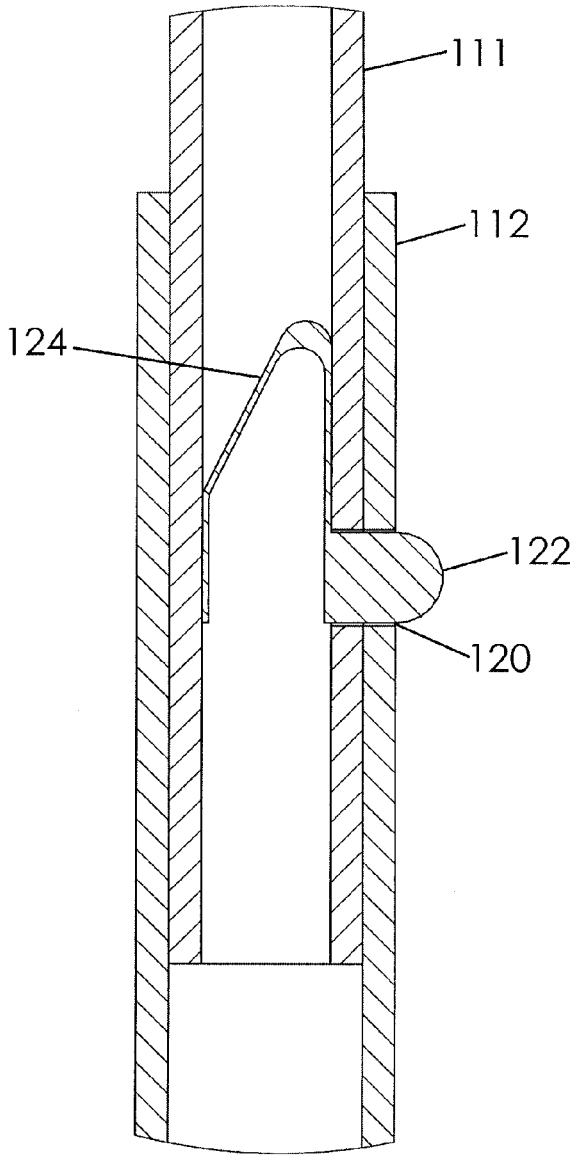
FIG. 7 is an isolated view on an enlarged scale taken from FIG. 6*b;*
Figure 8:
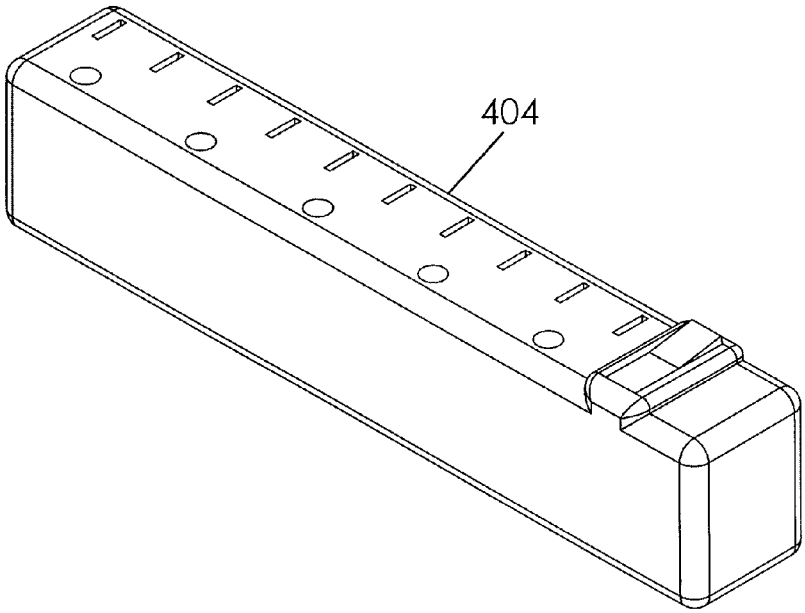
FIG. 8 is a perspective view of an electrical power strip removed from the housing.
Figure 9A:
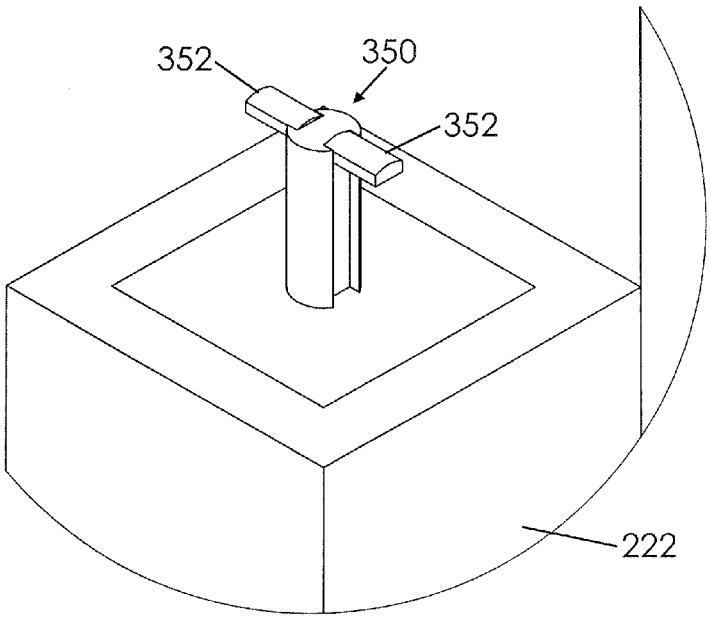
FIG. 9*a* is an isolated view on an enlarged scale taken from FIG. 1 showing a pair of springable flanges in an uncompressed configuration.
Figure 9B:
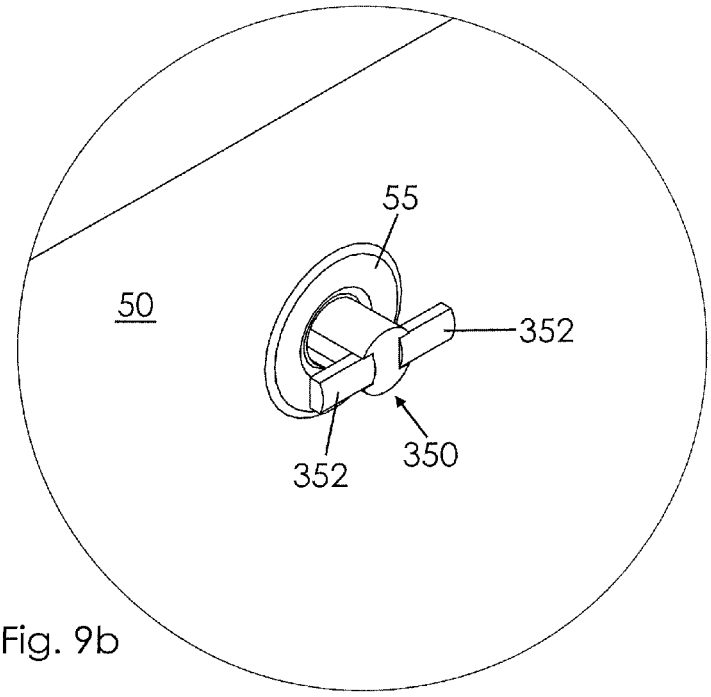
FIG. 9*b* is an isolated view on an enlarged scale taken from FIG. 5.
Figure 10A:
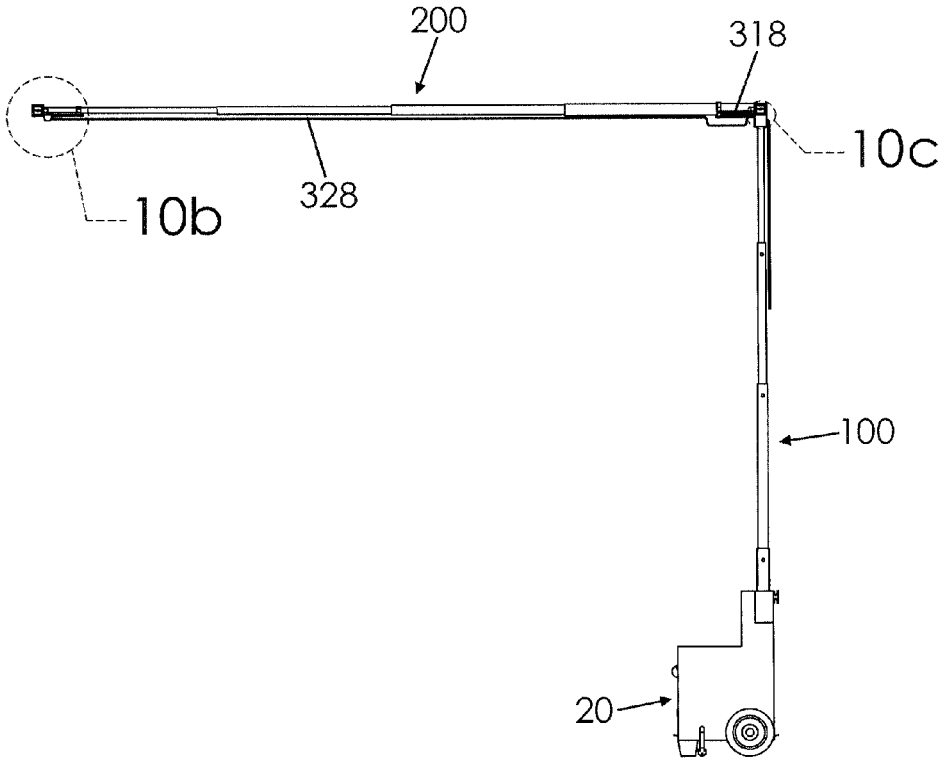
FIG. 10*a* is a side elevation view of the mobile sheltered workstation, as in FIG. 4.
Figure 10B:
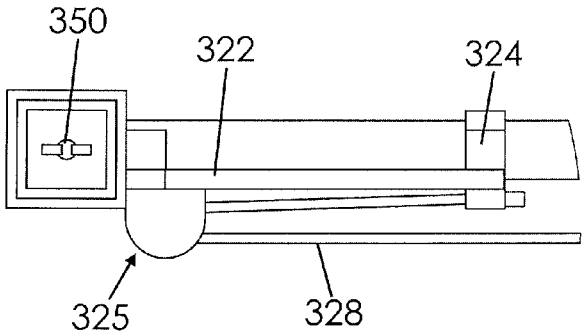
FIG. 10*b* is an isolated view on an enlarged scale taken from FIG. 10*a;*
Figure 10C:
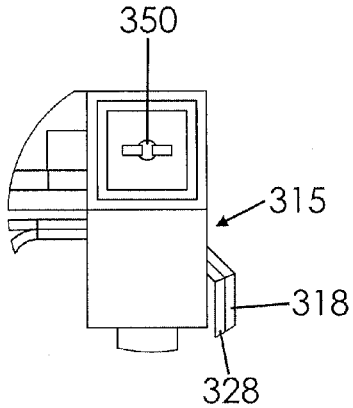
FIG. 10*c* is an isolated view on an enlarged scale taken from FIG. 10*a;*
Figure 11A:
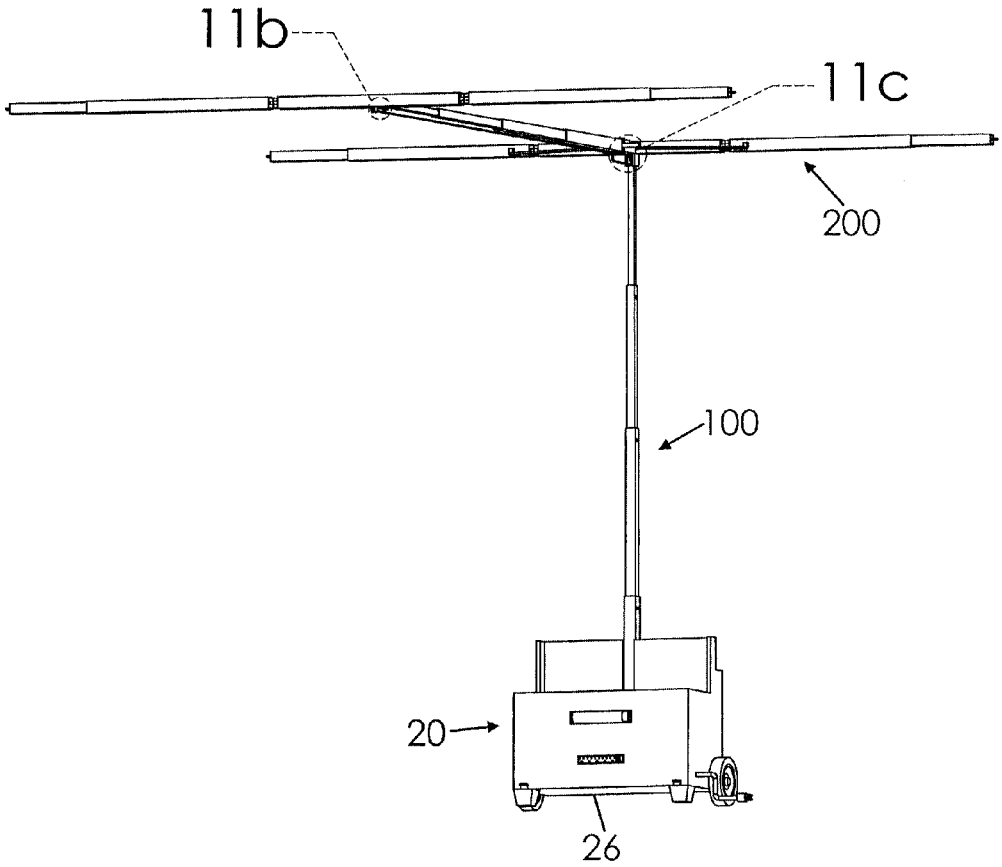
FIG. 11*a* is a perspective view of the mobile sheltered workstation, as in FIG. 4, shown from a different angle than FIG. 4.
Figure 11B:
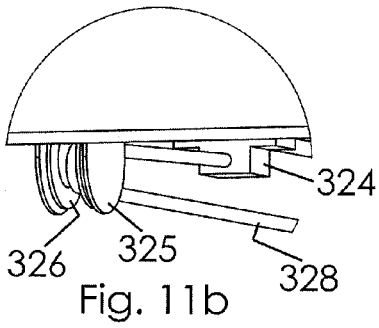
FIG. 11*b* is an isolated view on an enlarged scale taken from FIG. 11*a;*
Figure 11C:
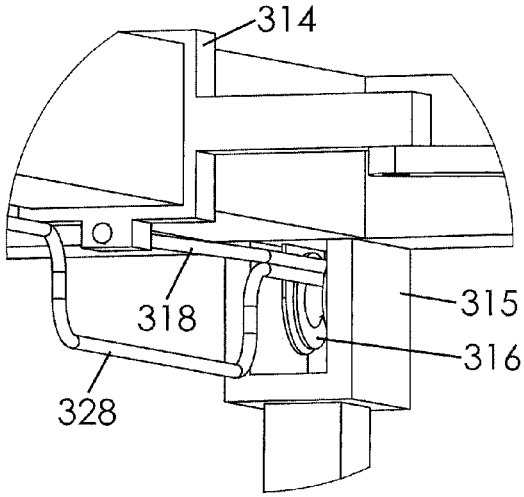
FIG. 11*c* is an isolated view on an enlarged scale taken from FIG. 11*a;*

The plurality of main support member sections 110 may include at least a first support member section 111 and a second support member section 112. A pin 122 may be coupled to the first main support member section 111. A spring 124 may be coupled to the pin 122 so as to bias the pin 122 towards the second support member section 112 such that the pin 122 couples the first support member section 111 to the second support member section 112 by engaging respective holes 120 in the first 111 and second 112 support member sections, respectively (FIG. 7).

The canopy framework 200 may be moved between a stowed configuration (FIG. 1) and a deployed configuration (FIG. 4*a*). Accordingly, the canopy framework may include a lower end 204 having an attachment flange 250 configured to selectively couple to an upper end 104 of the main support member 100. The upper end 104 of the main support member 100 may define an attachment bore 150 configured to receive the attachment flange 250 of the canopy framework 200. The upper end 104 of the main support member 100 may further define a locking hole 152 configured to receive a locking pin (not shown) so as to lock the canopy framework 200 to the main support member 100 when the attachment flange 250 of the canopy framework 200 is received by the attachment bore 150 of the main support member 100. The canopy framework 200 is generally adjacent the housing 20 at the stowed configuration (FIG. 1) and displaced from the housing 20 at the deployed configuration (FIG. 4*a*).

The canopy framework 200 may also include a main support brace 230 having a first end 231 and a second end 232. The main support brace 230 may be length adjustable and telescopically movable between a retracted configuration (FIG. 2) and an extended configuration (FIG. 3) so as to coincide with the stowed and deployed configurations of the canopy framework 200, respectively.

The canopy framework 200 may also include a first support brace 210 coupled to the first end 231 of the main support brace 230 and/or a second support brace 220 coupled to the second end 232 of the main support brace 230. In one embodiment, the first support brace 210 may be fixedly coupled to the first end 231 of the main support brace 230 and the attachment flange 250 may be coupled to the first support brace 210. Consequently, the first support brace 210 of the canopy framework 200 may be removably coupled to the upper end 104 of the main support member 100 when the attachment flange 250 of the canopy framework 200 is received by the attachment bore 150 of the main support member 100. It is understood that, in another embodiment, the attachment flange 250 may be coupled to the main support brace 230 and/or the second support brace 220.

Figure 2:
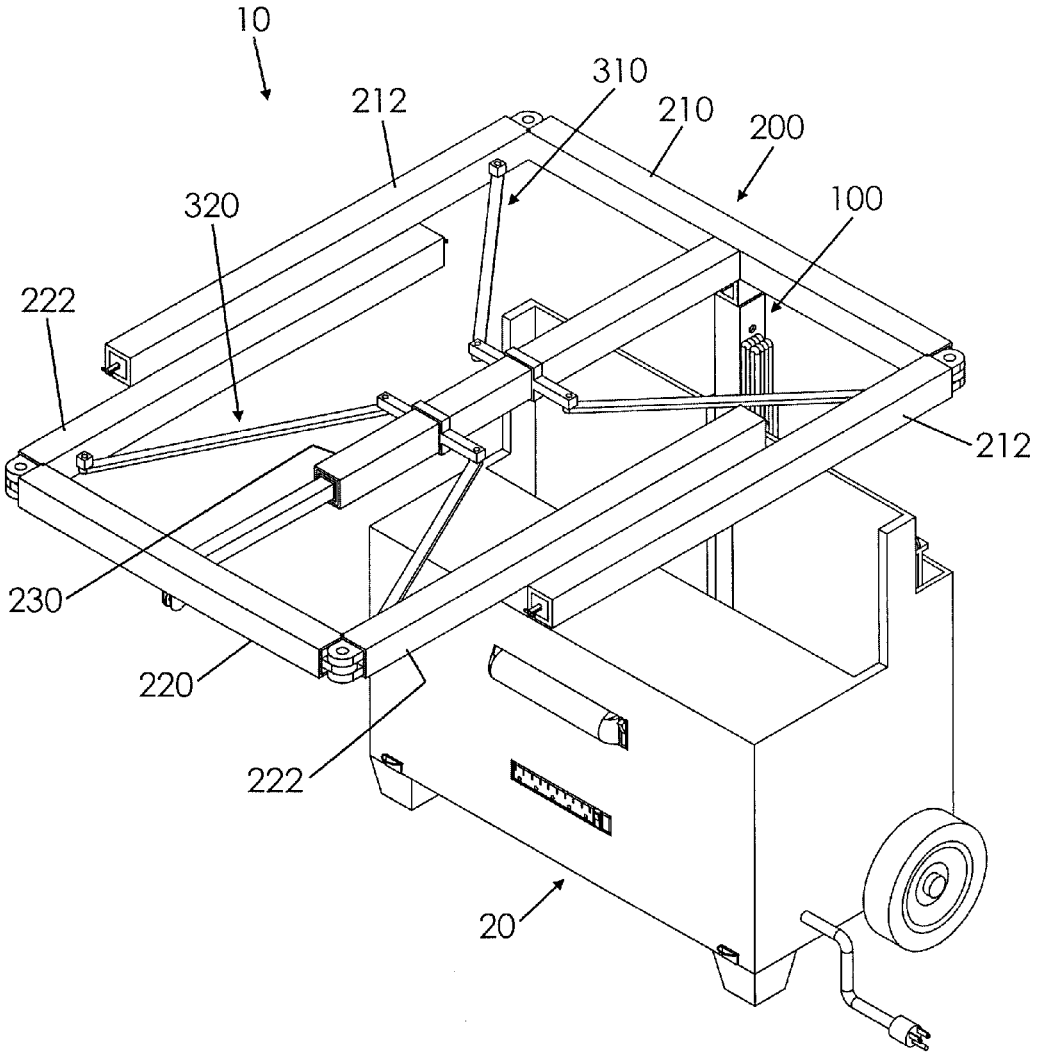
FIG. 2 is a perspective view of the mobile sheltered workstation, as in FIG. 1, illustrating the canopy framework in a deployed configuration with a pair of first arms and a pair of second arms in a stowed and retracted configuration and a main support brace in a retracted configuration.

The canopy framework 200 may also include a pair of first arms 212 coupled to opposed ends of the first support brace 210, respectively. Each one of the pair of first arms 212 may be movable between a stowed configuration (FIG. 2) and a deployed configuration (FIG. 3). Each one of the pair of first arms 212 may be generally parallel to the main support brace 230 when at the stowed configuration and generally perpendicular to the main support brace 230 when at the deployed configuration.

The pair of first arms 212 may be pivotally coupled to opposed ends of the first support brace 210, respectively, so as to enable the pair of first arms 212 to rotatably move from the stowed configuration to the deployed configuration. Additionally, each one of said pair of first arms 212 may be length adjustable and telescopically movable between a retracted configuration (FIG. 2) and an extended configuration (FIG. 3) so as to coincide with the stowed and deployed configurations of the canopy framework 200, respectively.

The canopy framework 200 may further include a first linkage assembly 310 operatively coupled to the pair of first arms 212 and the main support brace 230. More particularly, the first linkage assembly 310 may include a first collar 314 slidably coupled to the main support brace 230. The first linkage assembly 310 may also include a pair of first deployment members 312 extending between the first collar 314 and the pair of first arms 212, respectively, such that the pair of first arms 212 is rotated between a stowed configuration and a deployed configuration when the first collar 314 is slidably moved along the main support brace 230.

In one embodiment, the first linkage assembly 310 may include a pair of first collars 314, each of the pair of first collars 314 being slidably coupled to one of the pair of first arms 212, and a pair of first deployment members 312 extending between the main support brace 230 and the pair of first collars 314, respectively, such that each of the pair of first arms 212 may be rotated between a stowed configuration and a deployed configuration when a respective first collar 314 is slidably moved along the respective first arm 212.

In yet another embodiment, the first linkage assembly 310 may include a pair of first deployment members 312 coupled to the main support brace 230 and the pair of first arms 212, respectively, so as to hold the pair of first arms 212 in a stowed configuration and/or a deployed configuration. Each of the pair of first deployment members 312 may be removable, may be bisected with a pivot joint (not shown) so as to operate as a hinge, and/or may be length adjustable and telescopically movable between a retracted configuration and an extended configuration.

The canopy framework 200 may further include a first pulley assembly 315 having a first pulley 316. A first cord 318 may be selectively coupled to the first pulley 316 and the first linkage assembly 310 so as to cause the first collar 314 to slidably move along the main support brace 230 when tension is exerted upon the first cord 318. With this construction, operation of the first pulley assembly 315 enables a user to move the pair of first arms 212 between stowed and deployed configurations by pulling on the first cord 318.

The canopy framework 200 may also include a pair of second arms 222 coupled to opposed ends of the second support brace 220, respectively. Each one of the pair of second arms 222 may be movable between a stowed configuration (FIG. 2) and a deployed configuration (FIG. 3). Each one of the pair of second arms 222 may be generally parallel to the main support brace 230 when at the stowed configuration and generally perpendicular to the main support brace 230 when at the deployed configuration. Consequently, the pair of second arms 222 may be generally parallel to and displaced from the pair of first arms 212 when the respective pairs of first 212 and second 222 arms are at the deployed configuration. Additionally, the pair of second arms 222 may be generally parallel and adjacent to the pair of first arms 212 when the respective pairs of first 212 and second 222 arms are at the stowed configuration. Respective first 210 and second 220 support braces and/or respective pairs of first 212 and second 222 arms may be configured so as to allow the pair of second arms 222 to nest inside of the pair of first arms 212 when respective pairs of first 212 and second 222 arms are at the stowed configuration (as best shown in FIG. 2).

The pair of second arms 222 may be pivotally coupled to opposed ends of the second support brace 220, respectively, so as to enable the pair of second arms 222 to rotatably move from the stowed configuration to the deployed configuration as will be described more fully below. Additionally, each one of said pair of second arms 222 may be length adjustable and telescopically movable between a retracted configuration (FIG. 2) and an extended configuration (FIG. 3) so as to coincide with the stowed and deployed configurations of the canopy framework 200, respectively.

The canopy framework 200 may further include a second linkage assembly 320 coupled to the pair of second arms 222 and the main support brace 230. The second linkage assembly 320 may include a second collar 324 slidably coupled to the main support brace 230. The second linkage assembly 320 may also include a pair of second deployment members 322 extending between the second collar 324 and the pair of second arms 222, respectively, such that the pair of second arms 222 is rotated between a stowed configuration and a deployed configuration when the second collar 324 is slidably moved along the main support brace 230.

In one embodiment, the second linkage assembly 320 may include a pair of second collars 324, each of the pair of second collars 324 being slidably coupled to one of the pair of second arms 222, and a pair of second deployment members 322 extending between the main support brace 230 and the pair of second collars 324, respectively, such that each of the pair of second arms 222 is rotated between a stowed configuration and a deployed configuration when the respective second collar 324 is slidably moved along the respective second arm 222.

The second linkage assembly 320 may also include a pair of second deployment members 322 coupled to the main support brace 230 and the second pair of arms 222, respectively, so as to hold the second pair of arms 222 in a stowed configuration and/or a deployed configuration. Each of the pair of second deployment members 322 may be removable, may be bisected with a pivot joint (not shown) so as to operate as a hinge, and/or may be length adjustable and telescopically movable between a retracted configuration and an extended configuration.

The canopy framework 200 may further include a second pulley assembly 325 having a second pulley 326. A second cord 328 may be selectively coupled to the second pulley 326 and the second linkage assembly 320 so as to cause the second collar 324 to slidably move along the main support brace 230 when tension is exerted upon the second cord 328. With this construction, operation of the second pulley assembly 325 enables a user to move the pair of second arms 222 between stowed and deployed configurations by pulling on the second cord 328.

The canopy framework 200 may also include a plurality of canopy attachment mechanisms 350 and the canopy 50 may include a plurality of canopy attachment elements 55. Each canopy attachment mechanism 350 of the canopy framework 200 may be configured to interface with one or more canopy attachment element 55 of the canopy 50. Each canopy attachment element 55 of the canopy 50 may be a grommet.

The canopy attachment mechanism 350 may include opposed springable flanges 352 that are selectively movable between compressed and uncompressed configurations. The springable flanges 352 may be configured so as to allow a canopy attachment element 55 of the canopy 50 to slide over the springable flanges 352 of one of the canopy attachment mechanisms 350 when the springable flanges 352 of the canopy attachment mechanism 350 are at the compressed configuration. Consequently, the canopy 50 may be coupled to or decoupled from the canopy framework 200 by sliding respective canopy attachment elements 55 of the canopy 50 over springable flanges 352 of respective canopy attachment mechanisms 350 of the canopy framework 200. Additionally, the springable flanges 352 may be configured so as to prevent respective canopy attachment elements 55 of the canopy 50 from sliding over springable flanges 352 of respective canopy attachment mechanisms 350, thereby preventing the canopy 50 from decoupling from the canopy framework 200.

In one embodiment, the canopy 50 may include one set of canopy attachment elements 55 so as to selectively couple to the canopy framework 200 to cover a predetermined geometric area. In another embodiment, the canopy 50 may include multiple sets of canopy attachment elements 55 so as to selectively couple to the canopy framework 200 to cover a variety of geometric areas. It is understood that the canopy my also include a rain shield cover positioned over each canopy attachment element so as to prevent leakage through the canopy.

The canopy framework 200 may be adjustable to accommodate different canopy 50 sizes to accommodate different shelter requirements such as when high winds at or obstacles near a worksite prevent the use of a large canopy 50 or when a large worksite requires the use of a large canopy. The main support brace 230 and/or the first 212 and second 222 pairs of arms may be extendable and/or retractable to accommodate different canopy 50 lengths and/or widths. Additionally, respective pairs of first 212 and second 222 arms may be rotatable to provide additional flexibility for accommodating different canopy 50 sizes.

The canopy framework 200 may be adjustable to accommodate different canopy 50 shapes to accommodate different shelter requirements such as when obstacles near a worksite require the use of a canopy 50 with a shape other than the rectangular shape shown in the drawings. The main support brace 230 and/or the first 212 and second 222 pairs of arms may be extendable and/or retractable to accommodate different canopy 50 shapes. Additionally, respective pairs of first 212 and second 222 arms may be rotatable to provide additional flexibility for accommodating different canopy 50 shapes.

The canopy framework 200 may be adjustable to accommodate different canopy 50 tension requirements to accommodate different shelter requirements, such as to tighten the canopy during high winds or to allow the canopy to droop on one or more sides to divert rain water from a worksite. The main support brace 230 and/or the first 212 and second 222 pairs of arms may be extendable and/or retractable to accommodate different canopy 50 tension requirements. Additionally, respective pairs of first 212 and second 222 arms may be rotatable to provide additional flexibility for accommodating different canopy 50 tension requirements.

In use, the mobile sheltered workstation 10 provides a person with a mobile worksite shelter. It should be appreciated that the main support member 100 and the canopy framework 200 may be stored in the back of a truck or van—so as to provide easier transportation to and from a worksite—when they are at retracted and stowed configurations, respectively. Upon arrival at the worksite, a canopy 50 may be coupled to the canopy framework 200 and the main support member 100 and the canopy framework 200 may be coupled together and moved to extended and deployed configurations, respectively, so as to create a quick and convenient shelter at the worksite. Further, an electrical power strip 404 may provide safe and convenient access to electricity at the worksite and a light 408 may illuminate the worksite.

It is understood that while certain forms of this invention have been illustrated and described, it is not limited thereto except insofar as such limitations are included in the following claims and allowable functional equivalents thereof.

The invention claimed is:

1. A mobile sheltered workstation, comprising:

a housing;

a main support member having a lower end coupled to said housing and extending upwardly therefrom, said main support member being length adjustable and telescopically movable between a retracted configuration and an extended configuration;

a canopy framework having a lower end selectively coupled to an upper end of said main support member and movable between a stowed configuration adjacent said housing and a deployed configuration displaced from said housing;

wherein said canopy framework includes:

a main support brace having a first end and a second end, said main support brace being length adjustable and telescopically movable between a retracted configuration and an extended configuration;

a first support brace fixedly coupled to said first end of said main support brace and removably coupled to said upper end of said main support member;

a second support brace coupled to said second end of said main support brace, said first support brace being parallel to said second support brace and perpendicular to said main support brace;

a pair of first arms pivotally coupled to opposed ends of said first support brace, respectively;

wherein said each one of said pair of first arms is length adjustable and telescopically movable between a retracted configuration and an extended configuration;

a first linkage assembly coupled to said pair of first arms, said first linkage assembly having a first collar slidably coupled to said main support brace and a pair of first deployment members extending between said first collar and said first arms, respectively, such that said pair of first arms is rotated between a stowed configuration and a deployed configuration when said first collar is slidably moved along said main support brace;

wherein:

said pair of first arms is generally parallel to said main support brace when said pair of first arms is at said stowed position;

said pair of first arms is generally perpendicular to said main support brace when said pair of first arms is rotated to said deployed position;

a first pulley coupled to said canopy framework; and a first cord coupled to said first linkage assembly and said first pulley and configured so as to cause said first collar to slidably move along said main support brace when tension is exerted upon said first cord.

2. The mobile sheltered workstation as in claim 1, further comprising a canopy selectively coupled to said canopy framework and configured to cover a geometric area thereof.

3. The mobile sheltered workstation as in claim 1, wherein:

said main support member includes a plurality of main support member sections configured to nest within said main support member at said retracted configuration and to incrementally extend upwardly from said main support member at said extended configuration; and said plurality of main support member sections are secured at selected positions when said main support member is at said extended configuration.

4. The mobile sheltered workstation as in claim 3, wherein each main support member section defines at least one hole configured to receive a pin so as to hold said plurality of main support member sections at respective selected positions.

5. The mobile sheltered workstation as in claim 4, wherein:

said plurality of main support member sections includes at least a first support member section and a second support member section; and said pin is coupled to said first main support member section and is spring biased towards said second main support member section such that said pin couples said first support member section to said second support member section by engaging respective holes in said first and said second support member sections, respectively.

6. The mobile sheltered workstation as in claim 5, wherein said second main support member section defines a plurality of holes configured to receive said pin so as to couple said second support member section at a selected vertical position relative to said first support member section.

7. The mobile sheltered workstation as in claim 1, further comprising:

a pair of second arms pivotally coupled to opposed ends of said second support brace, respectively;

a second linkage assembly coupled to said pair of second arms, said second linkage assembly having a second collar slidably coupled to said main support brace and a pair of second deployment members extending between said second collar and said second arms, respectively, such that said pair of second arms is rotated between a stowed configuration and a deployed configuration when said second collar is slidably moved along said main support brace;

a second pulley coupled to said canopy framework;

a second cord coupled to said second linkage assembly and to said second pulley and configured so as to cause said second collar to slidably move along said main support brace when tension is exerted upon said second cord.

8. The mobile sheltered workstation as in claim 7, wherein:

said pair of second arms is generally parallel and adjacent to said pair of first arms when respective pairs of said first and second arms are rotated to said stowed configurations, respectively; and said pair of second arms is generally parallel to and displaced from said pair of first arms when respective pairs of said first and second arms are rotated to said deployed configurations, respectively.

9. The mobile sheltered workstation as in claim 1, wherein said canopy framework includes at least one canopy attachment mechanism configured to selectively couple a canopy to said canopy framework.

10. The mobile sheltered workstation as in claim 9, wherein said canopy attachment mechanism includes opposed springable flanges that are selectively movable between compressed and uncompressed configurations, said springable flanges being configured to capture said canopy when said springable flanges are at said uncompressed configuration and to release said canopy when said springable flanges are at said compressed configuration.

11. The mobile sheltered workstation as in claim 1, further comprising at least one tie down cable selectively coupled to said canopy framework and at least one tie down stake selectively coupled to said tie down cable.

12. The mobile sheltered workstation as in claim 1, wherein said housing defines an interior area.

13. The mobile sheltered workstation as in claim 12, further comprising an electrical power strip positioned in said interior area of said housing, said housing including an exterior wall defining an aperture configured to provide operative access to said power strip.

14. The mobile sheltered workstation as in claim 1, further comprising:

a pair of wheels rotatably coupled to opposed sides of said housing; and a plurality of tie down attachments coupled to said housing.

* * * * *